US007691800B2

(12) United States Patent
Weiss

(10) Patent No.: US 7,691,800 B2
(45) Date of Patent: Apr. 6, 2010

(54) WATER-BASED CLEANING AGENT AND METHOD FOR CLEANING A SPRAY GUN

(75) Inventor: William S. Weiss, Cary, IL (US)

(73) Assignee: B-Tech IP Holdings, LLC, McHenry, IL (US)

( * ) Notice: Subject to any disclaimer, the term of this patent is extended or adjusted under 35 U.S.C. 154(b) by 225 days.

(21) Appl. No.: 11/468,655

(22) Filed: Aug. 30, 2006

(65) Prior Publication Data

US 2008/0072927 A1 Mar. 27, 2008

(51) Int. Cl.
*C11D 7/50* (2006.01)

(52) U.S. Cl. ..... 510/201; 510/505

(58) Field of Classification Search ..... 510/201, 510/505

See application file for complete search history.

(56) References Cited

U.S. PATENT DOCUMENTS

| | | | | |
|---|---|---|---|---|
| 3,305,137 A | | 2/1967 | Gauthier et al. | |
| 4,592,787 A | * | 6/1986 | Johnson | 134/38 |
| 5,288,029 A | | 2/1994 | Ishibashi et al. | |
| 5,328,093 A | | 7/1994 | Feitel et al. | |
| 5,421,899 A | | 6/1995 | Hamilton et al. | |
| 5,948,741 A | * | 9/1999 | Ochomogo et al. | 510/191 |
| 5,993,562 A | | 11/1999 | Roelofs | |
| 6,004,916 A | * | 12/1999 | Mills et al. | 510/238 |
| 6,017,872 A | * | 1/2000 | Pedersen et al. | 510/424 |
| 6,096,699 A | * | 8/2000 | Bergemann et al. | 510/201 |
| 2004/0259753 A1 | * | 12/2004 | Wilson et al. | 510/421 |

* cited by examiner

*Primary Examiner*—Gregory E Webb
(74) *Attorney, Agent, or Firm*—Vedder Price PC

(57) ABSTRACT

The present invention generally relates to a cleaning agent for a spray gun and a method and apparatus for cleaning the spray gun, and more specifically, to the agent and method of use thereof for cleaning a water-based spray gun using a novel cleaning agent comprising a solvent of n-butanol, a solvent of n-propanol, a surfactant of ethoxylated nonylphenol, and water. The cleaning agent may also be used under specific pH conditions and an emulsifier or a foam suppressor may be used. What is also contemplated is the use of a spray gun having smooth interior and exterior surfaces. The method contemplates the contacting of the cleaning agent with the spray gun, the recovering of the cleaning agent, the separating of the cleaning agent and the reuse of the cleaning agent. What is also contemplated is the use of the cleaning agent in an automatic washing apparatus and the use of the cleaning agent as part of a fluid supply to an automated spray gun to clean the spray gun access.

2 Claims, 5 Drawing Sheets

WATER-BASED CLEANING AGENT AND METHOD FOR CLEANING A SPRAY GUN

FIELD OF THE INVENTION

The present invention generally relates to a cleaning agent for a spray gun and a method and apparatus for cleaning the spray gun, and more specifically, to the agent and method of use thereof for cleaning a water-based spray gun.

BACKGROUND OF THE INVENTION

Automated systems have been developed over the years to replace and improve over known methods of applying paint using a brush, roller, or blade. Spray guns are often used to apply paint in a uniform coat or to cover large surface areas rapidly. Spray guns may be air-operated where a reservoir or compressor sends compressed air in the gun after being mixed in a desired proportion with paint to be sprayed onto a surface. Other spray guns are airless, where the spray is driven by pressurized paint routed to the nozzle area of a spray gun. Paint is generally stored in a container and is attached via a tube to the spray gun. Other types of spray guns include high volume/low pressure (HVLP) and electrostatic guns. A pumping means, such as an electrically driven or hydraulically operated pump, transports paint from the storage location to the nozzle of the spray gun. Spray guns are equipped with a release mechanism, generally in the form of a trigger.

The nozzle device is conveniently designed to be adapted to the shape of a hand-held gun. These guns are also frequently equipped for robots, which may be programmed to distribute and spread the paint over a surface more evenly than a person. Paint can be applied in solid form, such as a powder, or as a gaseous suspension, such as an aerosol or liquid. Since paint is designed to solidify if left unattended through evaporation of a solvent suspended in the paint, the painting equipment, such as spray guns, must be cleaned between applications in preparation for later reuse. Unlike petroleum-based paints, water-based paints are generally easier to dissolve in most solvents because water-based paints undergo a process of polymerization and do not dissolve when cleaning.

Manual and automatic systems have been devised to clean both the inside and outside of spray guns. Manual cleaning of spray guns is labor intensive and generates significant quantities of solvent waste. Automatic cleaning systems for spray guns are similar to conventional home dishwashing machines, except that the thinners and solvents to be used cannot be heated in the process due to the volatility of solvents. Automatic paint gun washers can reduce the amount of solvent used and paint solvent waste generated by up to 70-80% in comparison to manual paint gun cleaning. Petroleum-based paints, which can be dissolved readily, require less mechanical activity to remove dried paint, whereas water-based paints require high-pressure friction to remove dried paint. The solvents used to dissolve petroleum-based paints are generally more abrasive, less environment friendly, and require containment, storage, and filtration. Furthermore, the washing unit must be sealed. FIG. 1 shows an automated spray gun equipment device for petroleum-based paints found in the prior art.

What is needed is a water-based cleaning agent that may be used in conjunction with a water-based automated washing device and/or with a water-based spray gun and a method of cleaning the device that is both environmentally friendly and possesses sufficient cleaning capacity to operate as a dissolving mechanism for water-based paints.

SUMMARY

The present invention generally relates to a cleaning agent for a spray gun and a method and apparatus for cleaning a spray gun, and more specifically, the cleaning agent and method of use thereof for cleaning a water-based spray gun using a novel cleaning agent comprising a solvent such as n-butanol or n-propanol, a surfactant such as ethoxylated nonylphenol, and water. The cleaning agent may also be used under specific pH conditions, and an emulsifier or a foam suppressor may be used. What is also contemplated is the use of a spray gun having smooth interior and exterior surfaces. The method contemplates the contacting of the cleaning agent with the spray gun, the recovering of the cleaning agent, the separating of the cleaning agent, and the reuse of the cleaning agent. What is also contemplated is the use of the cleaning agent in an automatic washing apparatus and the use of the cleaning agent as part of the fluid supply to an automated spray gun to clean the spray gun access.

BRIEF DESCRIPTION OF THE DRAWINGS

The features of the present disclosure are believed to be novel and are set forth with particularity in the appended claims. The disclosure may best be understood by reference to the following description taken in conjunction with the accompanying drawings, and the figures that employ like reference numerals identify like elements.

DETAILED DESCRIPTION

In the following detailed description, reference is made to the accompanying drawings that show, by way of illustration, several embodiments of the disclosure, each centered around an improved cleaning agent for water-based paint spray guns. These embodiments are described with sufficient detail to enable one skilled in the art to practice the disclosure. It is understood that the various embodiments of the disclosure, although different, are not necessarily exclusive and can be combined differently because they show novel features. For example, a particular feature, structure, chemical element, or quantity described in connection with one embodiment may be implemented within other embodiments without departing from the spirit and scope of the disclosure. In addition, it is understood that the arrangement of individual elements and components within each disclosed embodiment may be modified without departing from the spirit and scope of the disclosure. Therefore, the following detailed description is not to be taken in a limiting sense.

Figure 1:
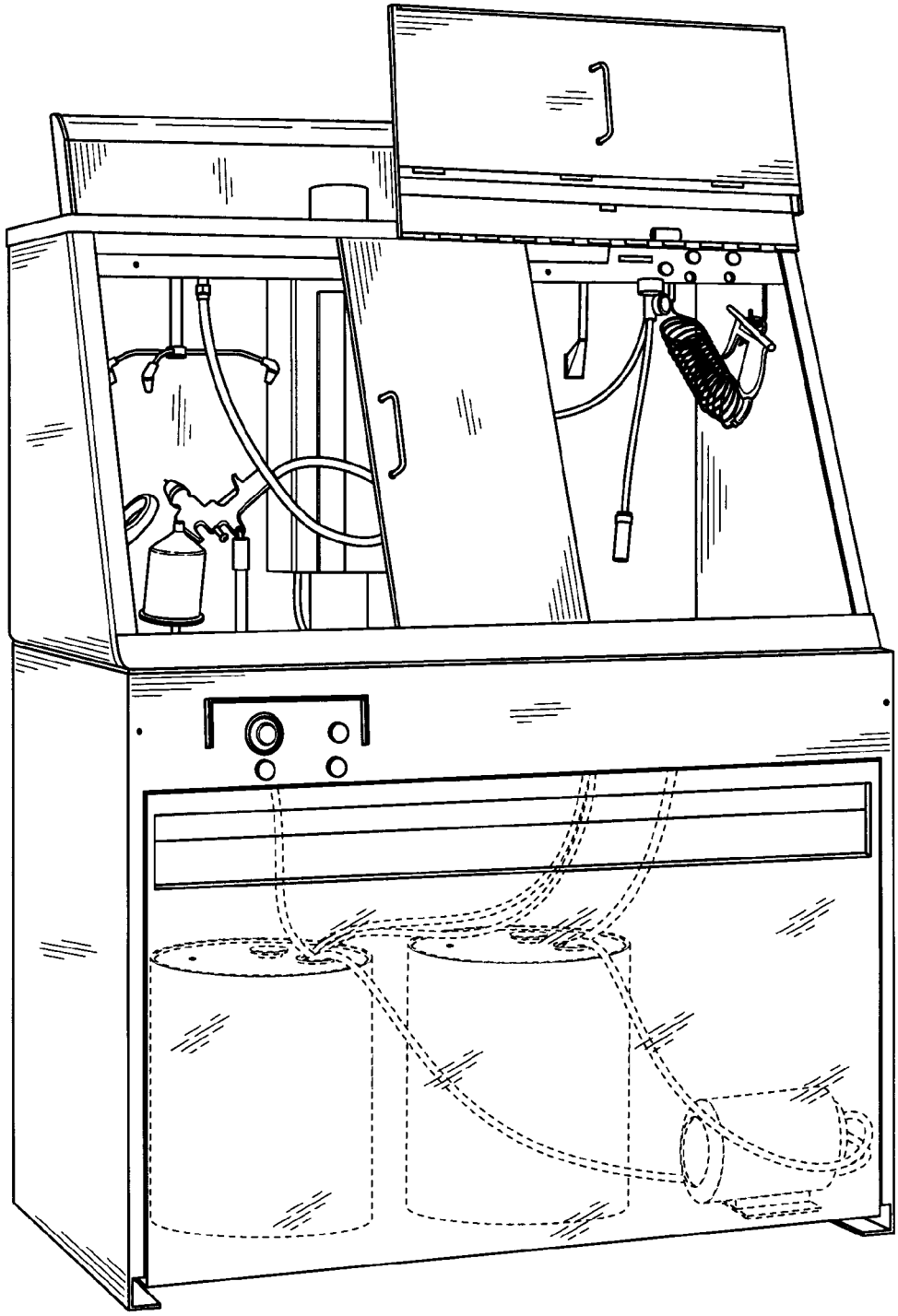
FIG. 1 (Prior Art)
FIG. 1 is a 3D illustration of a petroleum-based paint spray gun cleaning apparatus as found in the prior art.
Figure 2:
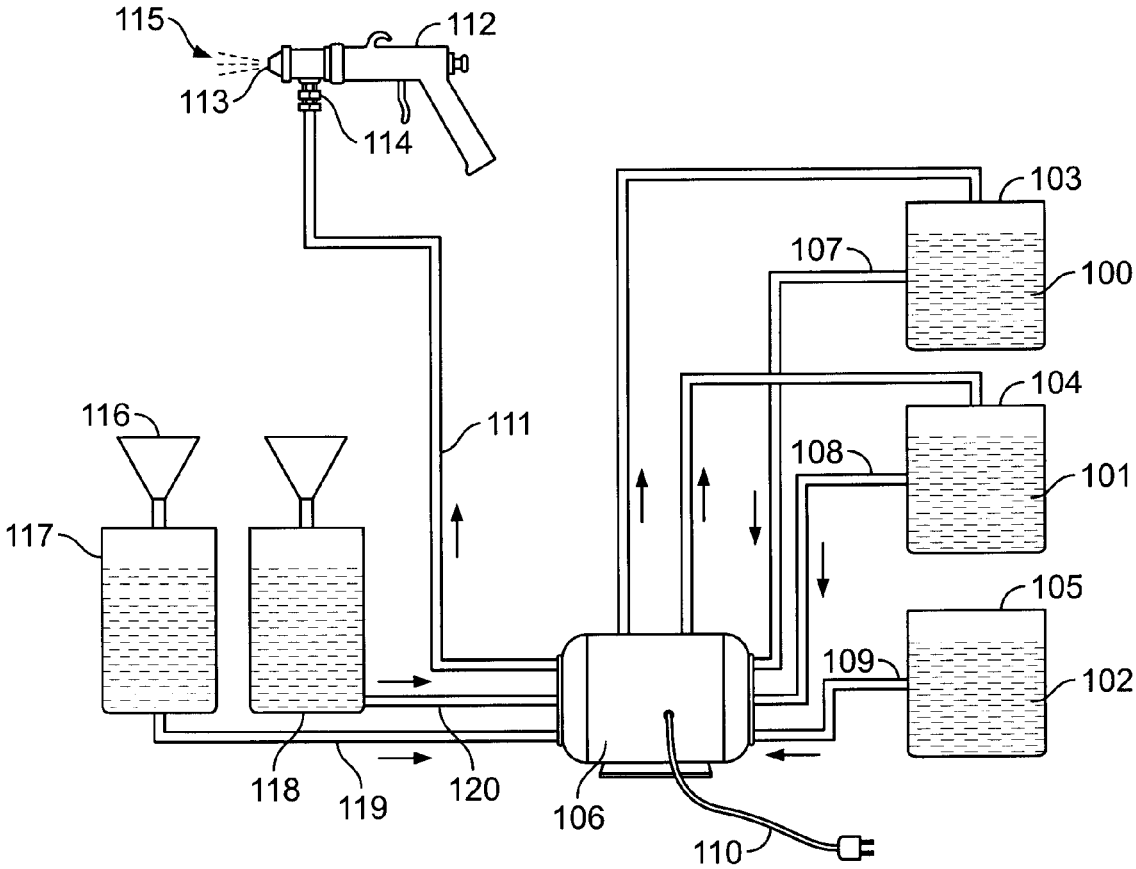
FIG. 2 is a functional diagram of a self-cleaning water-based paint spray gun system according to an embodiment of the present invention.

FIG. 2 shows an embodiment of the present disclosure relating to a self-cleaning water-based paint spray gun 112 comprising a means for pumping 106 paint 102 through the spray gun 112, a means for pumping 106 water 101 through the spray gun 112, and a means for pumping 106 a cleaning agent 100 through the spray gun 112. It is understood that while a single pumping means 106 is illustrated, such as an electrical pump to be connected to an electrical network by a connection cable 110, the pumping means is able to handle a plurality of different fluids because of its configuration. What is also contemplated is a system where several pumps are used for each fluid or for each function. It is understood by one of ordinary skill in the art that all commonly and industrially used transportation and pumping means are contemplated, including but not limited to gravitational pressure systems, hydraulic pumps, peristaltic pumps, hydroelectric pumps, pneumatic pumps, magnetic pumps, and the like. FIG. 2 shows fluid displacement within piping and tubes with flow arrows located next to each pipe or tube. What is contemplated is any transportation system able to transport paint 102, water 101, and a cleaning agent 100, either in liquid, solid, or aerosol form. FIG. 2 illustrates a sample spray gun 112 with a paint input connection 114 that may be locked in place and allows fluidic connection. While a system where the pumping means 106 is shown as pumping the cleaning agent 100, the water 101, and the paint 102 directly through the system, it is understood by one of ordinary skill in the art that a transportation fluid or gas, such as compressed air, can be used in the case of air-based spray gun. The following disclosure applies to all known types of paint spray gun technology. The spray gun is generally equipped with a nozzle 113 designed to release paint 102 onto a surface in the shape of a spray 115. In one embodiment, the spray gun comprises aluminum, steel, or alloys thereof. In another embodiment, the spray guns are made of a smooth surface material of at least twice the smoothness as conventional spray guns. The average roughness generally given in Ra corresponds to small scale height variations over a surface measured in millimeter or inches. A Ra of 12.5 as described in ANSI B16.5 corresponds to a variability of 12.5 micrometer, a value in the upper limit of a stock surface finish where some surface variability is visible to the naked eye. A Ra of 5 is described in ANSI B16.5 as value within the smooth finish surface where the surface appears flat to the naked eye. One of ordinary skill in the art will recognize that cleaning of a painted smoother surface is generally easier than the removal of pain from a rough or stock surface. What is contemplated herein is the use of a spray gun with a smoother surface. In a preferred embodiment, the surface of the spray gun has a roughness average of less than about 5 Ra. In a further embodiment, the cleaned spray guns have a smoother surface than spray guns cleaned with a wash that does not have a substantially neutral pH as determined from a comparison of electromicrographs of cleaned spray guns. FIG. 2 illustrates an embodiment where collectors 116 are accessible by the spray gun 112 or via a collection system (not shown) to collect the water 101 and the cleaning agent 100 in a used water container 117 or a used cleaning agent container 118. In one embodiment, the used water container 117 and the used cleaning agent container 118 have a roughness average of less than about 12.5 Ra on their interior surfaces. It is understood by one of ordinary skill in the art that while a specific value of surface roughness is given, the roughness is to be measure in connection with both the finish and material type in order to obtain an equal adherence of paint over the entire surface. It is understood by one of ordinary skill in the art that during phases of use of the cleaning agent 100 and the water 101, it is possible that the fluids will mix. What is shown is one possible embodiment, but what is contemplated is any system to collect and regenerate the fluids by known separation techniques, including but not limited to filtration, chemical separation, segregation, long-term storage, evaporation, and the like. FIG. 2 shows a possible embodiment where the fluids are collected via the return pipes 119 or 120 back to the pumping means 106 and regenerated into the water container 104 or the cleaning agent container 103 via piping. It is understood by one of ordinary skill in the art of fluid transportation, collection, and regeneration that the figure illustrate the optimal embodiment where all of the collected fluids are treated. What is contemplated is a system where these processes are performed in order to optimize the use of the fluids with the understanding that some fluids will be lost, discarded, polluted, evaporated, or lost to a drain (not shown). The means for the recovery of water 101 after use is shown as a collector 116 in the shape of a funnel and a reservoir 117, 118 able to store water 101 and the cleaning agent 100 before the water and cleaning agent 100 are sent back in the system via pipes 119, 120. It is understood by one of ordinary skill in the art that a plurality of means for recovery are contemplated, including but not limited to the physical collection by an operator, the use of collection devices, carts, drums, or other mobile or fixed apparatus, and that these systems will also be equipped with the appropriate transportation, storage, and treatment systems.

Figure 3:
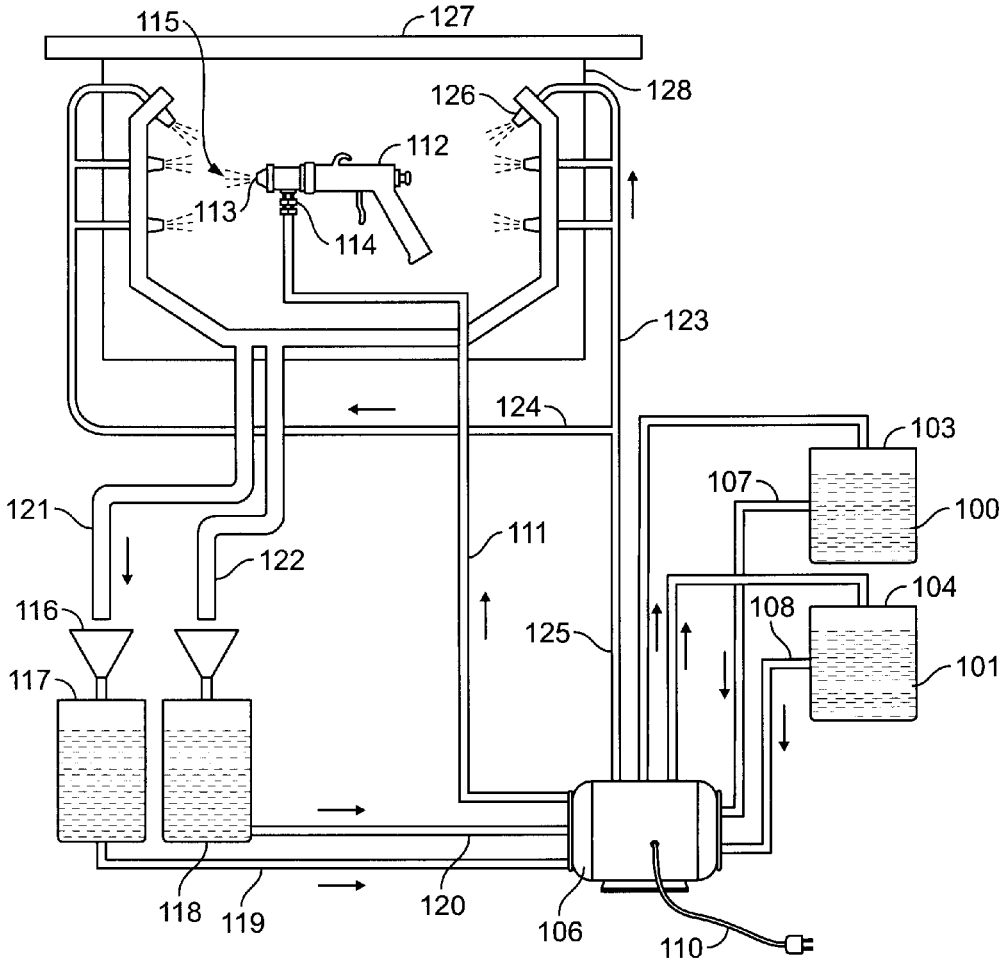
FIG. 3 is a functional diagram of a self-cleaning water-based paint spray gun washing apparatus according to an embodiment of the present invention.

FIG. 3 illustrates a self-cleaning water-based paint spray gun washing apparatus according to an embodiment of the present invention. Purely to simplify the understanding of FIG. 3, some of the elements are shown to be in the same embodiment as shown in FIG. 2, but it is understood that these elements may be arranged in any know functional configuration. FIG. 3 shows an enclave 128 equipped with a door 127 for access to the inside of the enclave. In one possible embodiment, a seal (not shown) is used to contain the fluids and associated vapors within the enclave 128. A series of nozzles 126 are used to disperse either the water 101 or the cleaning agent 100, which is pumped within the enclave 128 using the distribution system 123 or 124. A collection system 121, 122 collects the water 101 or the cleaning agent 100 within the enclave and transports the water 101 or the cleaning agent 100 to the collector 116 as described herebefore. While a gravitational system of collection with two different collectors 121, 123 is shown, it is understood by one of ordinary skill in the art that a single collector may be used to collect the water 101 and the cleaning agent 100 based on the separating means used to separate the cleaning agent 100 from the water 101. It is also understood that while no mechanical brushing system is shown, what is contemplated is the use within the enclave of any mechanical system currently known in association with spray gun cleaning systems, including but not limited to mild brushing, particular activation and displacement, or the use of a glove box cabinet and/or a remote operator.

The cleaning agent in one embodiment comprises a solvent of n-butanol, a solvent of n-propanol, a surfactant of ethoxylated nonylphenol at a specific pH between about pH7 and pH11. In another embodiment, the cleaning agent further comprises an emulsifier and or a foam suppressor. In a preferred embodiment, the pH of the cleaning agent is between about 8 to 10, and in another preferred embodiment, the pH is approximately pH9.11. Both the n-butanol and the n-propanol are polar protic solvents, and it is understood by one of ordinary skill in the art of solvents that polar protic solvents are hydrophilic and nonliopophilic, which dissolves polar compounds associated with water-based paint. The n-propanol is a primary alcohol in the propanol family. While one propanol is disclosed as a preferred embodiment, it is understood that any polar protic solvent, and more particularly, any propanol may be used. What is contemplated as a more preferred embodiment is the use of a concentration of about 1% in volume of n-propanol. The n-butanol, in a preferred embodiment, is used as a 2-Butoxyethanol, and in a more preferred embodiment, is used in a concentration of about 18% in volume. 2-Butoxyethanol is an organic solvent generally used for paints and other surface coatings and is able to decompose in the environment within a matter of days. 2-Butoxyethanol has not been identified as a major environmental contaminant or susceptible to build-up in plant or animal species. Ethoxylated nonylphenol is an organic surfactant in the family of alkylphenols generally used in industrial manufacture of surfactants or emulsifiers for emulsion polymerization. In a preferred embodiment, the ethoxylated nonylphenol is used in a concentration qualified as traces or lower than 0.01% in volume. In one alternate embodiment, the cleaning agent has a pH value between about pH7 and pH11 in an amount between about 2% and 40% in volume to remove paint lubricants from the spray gun before the lubricants dry. It is understood by one of ordinary skill in the art what while the use of water as a balancing element is contemplated within the cleaning agent, other neutral fluids may be used to transport the components of the cleaning agent. What is contemplated in a preferred embodiment is a variability of the given concentrations by about 10% rounded up to the greater fractional percentage of the values given, but it will be understood by one of ordinary skill in the art that while a preferred embodiment is given, acceptable variability for cleaning agents and solvents may be superior to the given value while maintaining the properties and characteristics disclosed to practice this disclosure.

In yet another embodiment, a surfactant can be placed in contact with the spray gun to aid with the efficiency and cleaning capacity of the cleaning agent. Surfactants reduce the surface tension of water and the interfacial tension between oil and water. Surfactants in a washing machine reduce the creation of greasy films on the surface of objects such as a spray gun. In a preferred embodiment, the surfactant comprises one of nonylphenol, aklanolamide, (nonylphenoxy) polyethylene oxide, sodium salts of petroleum sulfonic acid, sorbitan sesquioleate, or a mixture thereof. It is understood by one of ordinary skill in the art that any alternate surfactant with equivalent properties is contemplated as being within the scope of this disclosure. The use of an emulsifier, in a preferred embodiment a triethanolamine, and in a more preferred embodiment triethanolamine at a concentration of about 1.64% in volume, is used to stabilize the emulsion and stabilize any interface between the elements of the cleaning agent and within the residual product of the cleaning process. The triethanolamine may alternatively be used as a pH balancer. It is understood by one of ordinary skill in the art that while a specific type of emulsifier is disclosed as a preferred embodiment, and a concentration is provided as a more preferred embodiment, what is contemplated is the use any emulsifier with equivalent emulsifier functions, including but not limited to a different concentration resulting in the same emulsification. The use of a foam suppressor such as a tetramethyl decynediol, in a preferred embodiment Surfynol® 104 marketed by Air Products, is used as surfactant with high biodegradation and low toxicity while being able to minimize foam creation when the cleaning agent is used. In a more preferred embodiment, the tetramethyl decynediol trade name Surfynol® 104 in very low concentrations of and around 0.01% in volume is used.

In one embodiment, the cleaning agent comprises one or more polar protic solvents, triethanolamine as an emulsifier having a concentration of 1.64% in volume, ethoxylated nonylphenol as a surfactant having a trace concentration of less than 0.01% in volume, Surfynol® 104 as a foam suppressor having a trace concentration of less than 0.01% in volume, and the balance being water. In another embodiment, the cleaning agent comprises 2-Butoxyethanol as a solvent having a concentration of 18% in volume, n-propanol as a solvent having a concentration of 1% in volume, triethanolamine as an emulsifier having a concentration of 1.64% in volume, ethoxylated nonylphenol as a surfactant having a trace concentration of less than 0.01% in volume, Surfynol® 104 as a foam suppressor having a trace concentration of less than 0.01% in volume, and the balance being water. In yet another embodiment, the cleaning agent comprises one or more polar protic solvents as a solvent, triethanolamine as an emulsifier having a concentration of 1.64% in volume, ethoxylated nonylphenol as a surfactant having a trace concentration of less than 0.01% in volume, Surfynol® 104 as a foam suppressor having a trace concentration of less than 0.01% in volume, and the balance being water.

Figure 4:
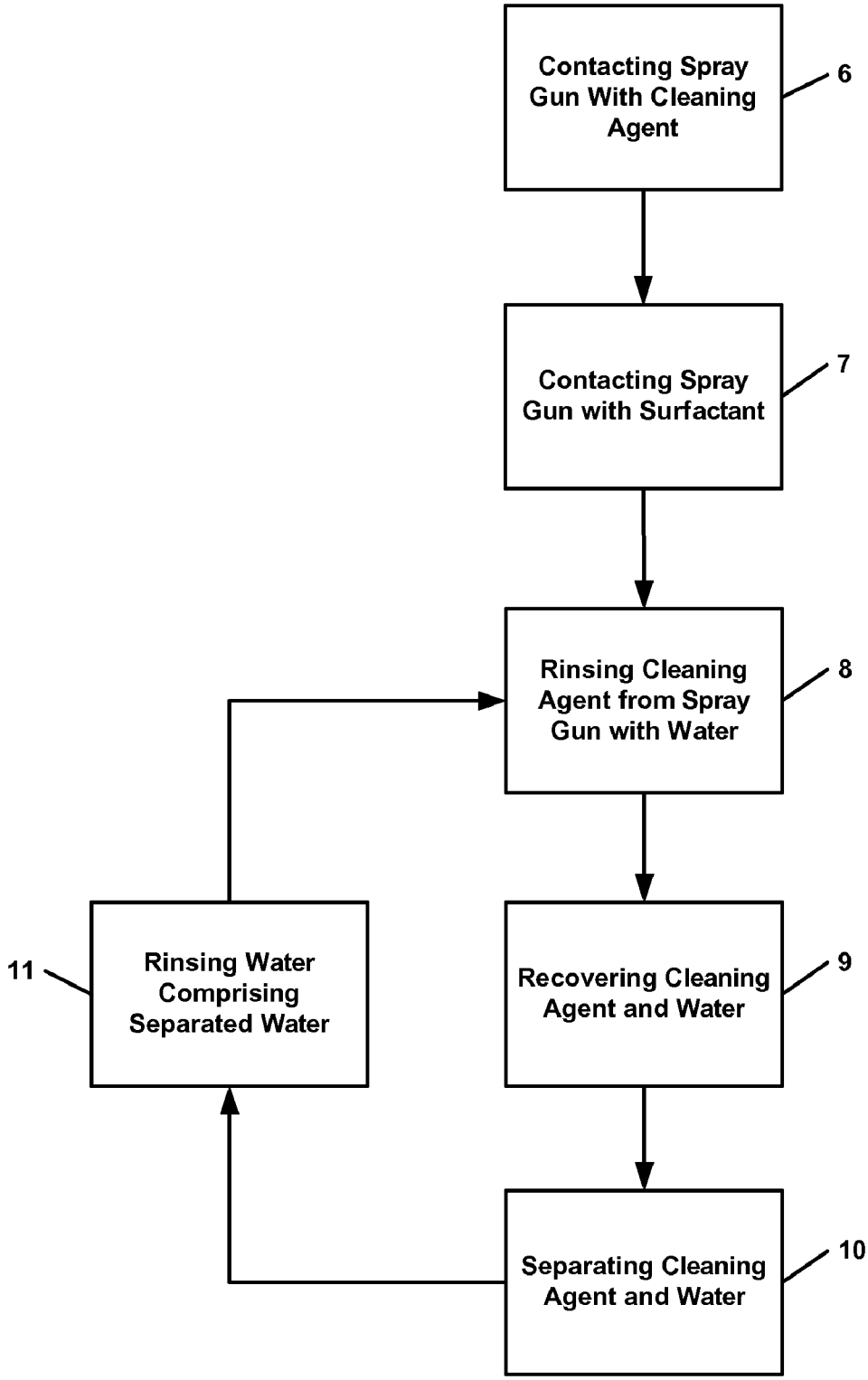
FIG. 4 is a block diagram of a method for cleaning water-based paint from a spray gun according to an embodiment of the present invention.
Figure 5:
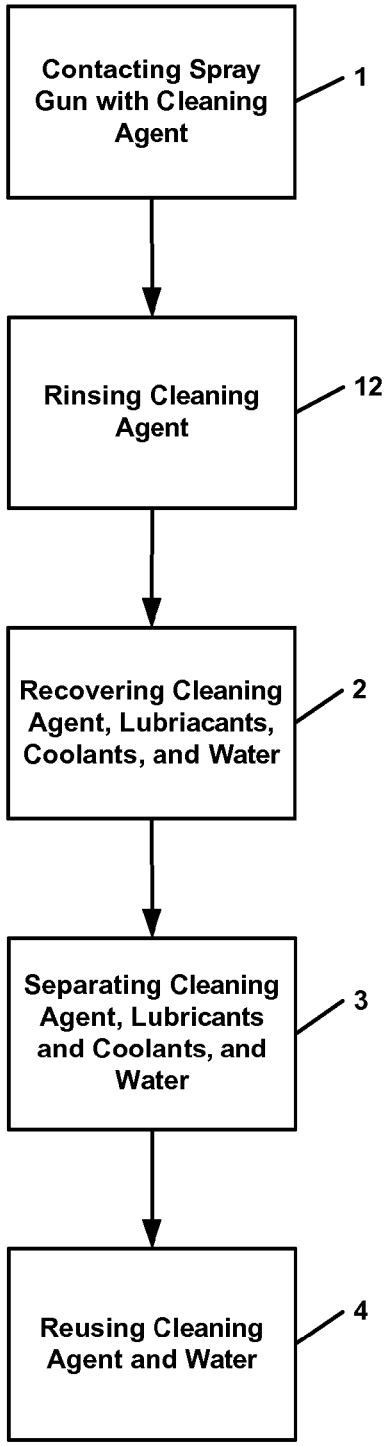
FIG. 5 is a block diagram of a method for cleaning a water-based paint spray gun according to another embodiment of the present invention.

FIG. 4 is a block diagram of a method for cleaning water-based paint from a spray gun according to an embodiment of the present invention. The method comprises a series of operations each conducted individually or, alternatively, in succession. The method comprises the contact of the spray gun with a cleaning agent 6, the contacting of the spray gun with a surfactant 7, the rinsing of the cleaning agent from the spray gun with water 8, the recovering of the cleaning agent and water 9, the separating of the cleaning agent from the water 10, and the rinsing of the cleaning agent from the spray gun with separated water 11. In another embodiment, shown as FIG. 5, the method comprises contacting the spray gun with a cleaning agent 1 having a pH value of from about 7 to about 11 to clean lubricants before the lubricants dry, the cleaning agent being effective to remove the lubricants deposited on and in the spray guns, rinsing the cleaning agent 12 and lubricants from the spray gun with water, the rinsed containers having a roughness average of less than about 12.5 Ra on the inside surface, recovering 2 the cleaning agent, lubricants, and water, separating 3 the cleaning agent, lubricants, with water, and 4 reusing the cleaning agent and water.

The invention is not limited to the particular details of the apparatus or method depicted and described herein, and other modifications and applications may be contemplated. Further changes may be made in the above-described method and device without departing from the true spirit of the scope of the invention herein involved. It is intended, therefore, that the subject matter in the above depiction should be interpreted as illustrative, not in a limiting sense.

What is claimed is:

1. A cleaning agent for water-based paint spray guns consisting essentially of:

2-butoxyethanol as a solvent having a concentration of 18%, plus or minus 0.2%;

n-propanol as a solvent having a concentration of 1%, plus or minus 0.1%;

triethanolamine as an emulsifier having a concentration of 1.64%, plus or minus 0.2%;

ethoxylated nonylphenol as a surfactant having a trace concentration of <0.01%, plus or minus 0.001%;

a foam suppressor having a trace concentration of <0.01%, plus or minus 0.001%; and the balance being water, wherein the cleaning agent has a pH of 7 to about 11.

2. The cleaning agent of claim 1 wherein the foam suppressor is Surfynol 104.

* * * * *